US010619847B2

(12) United States Patent
Seeley et al.

(10) Patent No.: US 10,619,847 B2
(45) Date of Patent: Apr. 14, 2020

(54) EFFLUENT GAS INLET ASSEMBLY FOR RADIANT BURNER

(71) Applicant: Edwards Limited, Burgess Hill, West Sussex (GB)

(72) Inventors: Andrew James Seeley, Bristol (GB); Duncan Michael Price, Wells (GB)

(73) Assignee: Edwards Limited, Burgess Hill, West Sussex (GB)

( * ) Notice: Subject to any disclaimer, the term of this patent is extended or adjusted under 35 U.S.C. 154(b) by 165 days.

(21) Appl. No.: 15/598,499

(22) PCT Filed: Dec. 10, 2015

(86) PCT No.: PCT/GB2015/053781

§ 371 (c)(1),
(2) Date: May 18, 2017

(87) PCT Pub. No.: WO2016/097697

PCT Pub. Date: Jun. 23, 2016

(65) Prior Publication Data

US 2018/0335209 A1 Nov. 22, 2018

(30) Foreign Application Priority Data

Dec. 15, 2014 (GB) ..... 1422247.5

(51) Int. Cl.
*F23D 14/12* (2006.01)
*F23D 99/00* (2010.01)
(Continued)

(52) U.S. Cl.
CPC ..... *F23D 14/12* (2013.01); *F23D 14/583* (2013.01); *F23D 14/84* (2013.01); *F23D 91/00* (2015.07); *F23D 14/58* (2013.01)

(58) Field of Classification Search
CPC ..... F23D 14/12; F23D 14/583; F23D 14/58; F23D 91/00; F23D 2203/005
(Continued)

(56) References Cited

U.S. PATENT DOCUMENTS 3,061,001 A * 10/1962 Reed ..... F23D 14/58 431/349
3,770,368 A 11/1973 Grayson et al.
(Continued)

FOREIGN PATENT DOCUMENTS

CN 101368731 A 2/2009
CN 102644928 A 8/2012
(Continued)

OTHER PUBLICATIONS

GB Combined Search and Examination Report Under Sections 17 and 18(3) dated Jun. 8, 2015 in corresponding GB Application GB 1422247.5—06 pgs.
(Continued)

*Primary Examiner* — Steven B McAllister
*Assistant Examiner* — Daniel E. Namay
(74) *Attorney, Agent, or Firm* — Westman, Champlin & Koehler, P.A.; Theodore M. Magee

(57) ABSTRACT

An inlet assembly for a burner includes an inlet nozzle defining an inlet aperture coupleable with an inlet conduit providing an effluent gas stream for treatment by the burner, a non-circular outlet aperture, and a nozzle bore extending along a longitudinal axis between the inlet aperture and the outlet aperture for conveying the effluent gas stream from the inlet aperture to the outlet aperture for delivery to the combustion chamber of the burner.

17 Claims, 7 Drawing Sheets

(51) Int. Cl.
*F23D 14/58* (2006.01)
*F23D 14/84* (2006.01)

(58) Field of Classification Search
USPC ..... 431/5
IPC ..... F23D 14/12,14/58, 14/84, 14/48
See application file for complete search history.

(56) References Cited

U.S. PATENT DOCUMENTS

| | | | | |
|---|---|---|---|---|
| 3,799,734 | A * | 3/1974 | Bailey | F23C 99/00 431/353 |
| 6,062,849 | A * | 5/2000 | Polidoro | F23D 14/10 431/114 |
| 10,161,628 | B2 * | 12/2018 | Seeley | F23C 99/006 |
| 2005/0205695 | A1 | 9/2005 | Geskin et al. | |
| 2007/0190469 | A1 * | 8/2007 | Clark | B01D 53/38 431/5 |
| 2009/0111064 | A1 * | 4/2009 | Li | F23C 6/047 431/10 |
| 2010/0173253 | A1 * | 7/2010 | Mohr | F02C 7/228 431/12 |
| 2011/0229836 | A1 | 9/2011 | Schutz et al. | |
| 2012/0240917 | A1 * | 9/2012 | Tolleneer | F24H 3/087 126/116 R |
| 2013/0143169 | A1 * | 6/2013 | Gangoli | F23D 14/58 431/8 |
| 2013/0213379 | A1 * | 8/2013 | Schultz | F24H 3/08 126/110 C |
| 2014/0080075 | A1 * | 3/2014 | Young | F23N 1/022 431/76 |
| 2014/0191059 | A1 * | 7/2014 | Baffigi | B05B 7/0815 239/11 |
| 2016/0123579 | A1 * | 5/2016 | Bridges | F23C 1/00 431/354 |
| 2018/0135852 | A1 * | 5/2018 | Martin | B23P 15/00 |
| 2019/0285272 | A1 * | 9/2019 | Benzeval | F23D 14/08 |

FOREIGN PATENT DOCUMENTS

| | | | | |
|---|---|---|---|---|
| CN | 103363545 | A | 10/2013 | |
| EP | 0335728 | A2 * | 10/1989 | C03B 5/2353 |
| EP | 0335728 | A2 | 10/1989 | |
| EP | 0538684 | A2 * | 4/1993 | F23D 14/22 |
| EP | 1205710 | | 5/2002 | |
| EP | 0694735 | A1 | 1/2016 | |
| JP | 06159626 | A * | 6/1994 | F23D 14/583 |
| JP | 2001153312 | A | 6/2001 | |
| JP | 2002250509 | A * | 9/2002 | |
| JP | 2014134350 | A | 7/2014 | |
| WO | 2009019140 | A | 2/2009 | |
| WO | 2011151735 | A | 12/2011 | |
| WO | 2014016566 | A2 | 1/2014 | |

OTHER PUBLICATIONS

International Search Report and Written Opinion dated Feb. 25, 2016 in corresponding International Application No. PCT/GB2015/053781—12 pgs.

Chinese Office Action dated Jul. 25, 2018 and Search Report dated Jul. 17, 2018 for corresponding Chinese Application No. CN201580068476.1.

Taiwanese Office Action dated Apr. 26, 2019 for corresponding Taiwanese Application No. 104141957.

Japanese Notification of Reason for Rejection dated Jun. 11, 2019 for corresponding Japanese Application No. 2017-531659.

* cited by examiner

EFFLUENT GAS INLET ASSEMBLY FOR RADIANT BURNER

This application is a national stage entry under 35 U.S.C. § 371 of International Application No. PCT/GB2015/053781, filed Dec. 10, 2015, which application claims priority from United Kingdom Application No. GB 1422247.5, filed Dec. 15, 2014, the entire content of which is incorporated herein by reference.

TECHNICAL FIELD OF THE INVENTION

The present invention relates to an inlet assembly for a burner and a method.

BACKGROUND OF THE INVENTION

Radiant burners are known and are typically used for treating an effluent gas stream from a manufacturing process tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion to remove the PFCs and other compounds from the effluent gas stream. Typically, the effluent gas stream is a nitrogen stream containing PFCs and other compounds. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner to affect flameless combustion at the exit surface, with the amount of air passing through the foraminous burner being sufficient to consume not only the fuel gas supplied to the burner, but also all the combustibles in the gas stream mixture injected into the combustion chamber.

The range of compounds present in the effluent gas stream and the flow characteristics of that effluent gas stream can vary from process tool to process tool, and so the range of fuel gas and air, together with other gases or fluids that need to be introduced into the radiant burner will also vary.

Although techniques exist for processing the effluent gas stream, they each have their own shortcomings. Accordingly, it is desired to provide an improved technique for processing an effluent gas stream.

SUMMARY OF THE INVENTION

According to a first aspect, there is provided an inlet assembly for a burner, the inlet assembly comprising: an inlet nozzle defining an inlet aperture coupleable with an inlet conduit providing an effluent gas stream for treatment by the burner, a non-circular outlet aperture, and a nozzle bore extending along a longitudinal axis between the inlet aperture and the outlet aperture for conveying the effluent gas stream from the inlet aperture to the outlet aperture for delivery to the combustion chamber of the burner, the nozzle bore having an inlet portion extending from the inlet aperture and an outlet portion extending to the non-circular outlet aperture.

The first aspect recognises that the processing of effluent gases can be problematic, particularly as the flow of those effluent gases increases. For example, a processing tool may output five effluent gas streams for treatment, each with a flow rate of up to 300 litres per minute (i.e. 1,500 litres per minute in total). However, existing burner inlet assemblies typically have four or six nozzles, each capable of supporting a flow rate of around only 50 litres per minute (enabling treatment of only 200 to 300 litres per minute in total). This is because the effluent treatment mechanism typically relies on a diffusion process within the radiant burner; the combustion by-products need to diffuse into the effluent stream in order to perform the abatement reaction. In other words, the combustion by-products need to diffuse from an outer surface of the effluent stream, all the way into the effluent stream, and then react with the effluent stream, before the effluent stream exits the radiant burner. Failure to completely diffuse into the effluent stream reduces the abatement efficacy. If the flow rates through the existing nozzles were increased to accommodate the increased amount of effluent stream, then the length of the radiant burner would need to increase proportionately to ensure the diffusion and reaction could occur prior to the faster-moving effluent stream exiting the radiant burner. Likewise, if the diameter of the existing nozzles were increased to accommodate the increased amount of effluent stream, then the length of the radiant burner would need to increase proportionately due to the increased time taken for the diffusion and reaction to occur in the larger diameter effluent stream.

Accordingly, an inlet assembly for a burner is provided. The inlet assembly may comprise an inlet nozzle. The inlet nozzle may define or be shaped to provide an inlet aperture or opening. The inlet aperture may couple or connect with the inlet conduit which provides an effluent gas stream to be treated by the burner. The inlet nozzle may also define or be shaped to provide a non-circular outlet aperture. The inlet nozzle may also define or be shaped to provide a nozzle bore which extends between the inlet aperture and the outlet aperture. The nozzle bore may extend along a longitudinal or effluent gas stream flow axis to convey the effluent stream from the inlet aperture to the outlet aperture in order to be delivered to the combustion chamber of the burner. The nozzle bore may also be formed of an inlet portion extending from or proximate to the inlet aperture. The nozzle bore may also have an outlet portion which extends or is proximate to the non-circular outlet aperture. In this way, the non-circular outlet aperture provides a non-circular effluent gas stream flow into the combustion chamber. The non-circular effluent gas flow enables a greater volume of effluent gas stream to be introduced into the combustion chamber whilst still achieving or exceeding the required levels of abatement. This is because a non-circular effluent gas stream provides a reduced distance along which diffusion and reaction needs to occur compared to that of an equivalent circular effluent gas stream.

Hence, an increased volume of effluent gas stream can be abated, compared to that of an equivalent circular effluent gas stream.

In one embodiment, a cross-sectional area of the inlet portion reduces along the longitudinal axis from the inlet aperture towards the outlet portion.

In one embodiment, a cross-sectional shape of the inlet portion transitions along the longitudinal axis from a shape of the inlet aperture to a shape of the outlet aperture. Providing a gradual transition with no discontinuities from the shape of the inlet aperture to the shape of the outlet aperture helps maintain a laminar flow and minimizes deposits caused by residues within the effluent stream.

In one embodiment, the inlet aperture is circular. It will be appreciated that the inlet aperture may be any shape which matches that of the conduit providing the effluent stream.

In one embodiment, the outlet aperture is elongate. Providing an elongate shaped outlet aperture helps to minimize the diffusion distance of the similarly-shaped effluent stream.

In one embodiment, the outlet aperture is a generally quadrilateral slot. This provides a similarly-shaped effluent stream with is wide and narrow, providing both a greater flow rate whilst minimising the distance from any point with the effluent stream to an edge of the effluent stream.

In one embodiment, the outlet aperture is an obround. An obround, which is a shape consisting of two semicircles connected by parallel lines tangent to their endpoints, provides an effluent stream with a predictable distance along which diffusion and reaction needs to occur within that effluent stream.

In one embodiment, the outlet aperture is formed from a plurality of co-located, discrete apertures. It will be appreciated that the outlet aperture could be formed from separate, but co-located, smaller apertures.

In one embodiment, a cross-sectional area of the outlet portion changes along the longitudinal axis from the outlet aperture towards the inlet portion.

In one embodiment, the cross-sectional area of the outlet portion reduces along the longitudinal axis from the outlet aperture towards the inlet portion.

In one embodiment, the inlet assembly comprises a baffle coupling the inlet portion with the outlet portion, the baffle defining a baffle aperture positioned within the nozzle bore, the baffle aperture having a reduced cross-sectional area compared to that of the outlet portion adjacent the baffle. Placing a baffle or restriction within the nozzle bore provides an obstruction and a discontinuity so that an expansion of flow occurs within the downstream outlet portion which helps to shape the effluent stream to minimize the diffusion distance.

In one embodiment, a cross-sectional area of the inlet portion reduces along the longitudinal axis from the inlet aperture towards the outlet portion to match the cross-sectional area of the baffle aperture. Accordingly, the size and the shape of the inlet portion may change to match that of the baffle aperture in order to further minimize the risks of deposits due to residues in the effluent stream.

In one embodiment, a cross-sectional shape of the inlet portion transitions along the longitudinal axis from a shape of the inlet aperture to a shape of the baffle aperture.

In one embodiment, a shape of the baffle aperture matches that of the outlet portion adjacent the baffle.

In one embodiment, the baffle aperture is formed from a plurality of co-located apertures. Accordingly, the baffle aperture may be formed from co-located but discrete apertures.

In one embodiment, the baffle is configured to provide the baffle aperture having a changeable cross-sectional area. Hence, the size of the baffle aperture may be varied or changed in order to suit the operating conditions.

In one embodiment, the baffle comprises a shutter operable to provide the changeable cross-sectional area.

In one embodiment, the shutter is biased to provide the changeable cross-sectional area which varies in response a velocity of the effluent gas stream. Accordingly, the area of the baffle aperture may change automatically in response to the flow rate of the effluent gas stream.

According to a second aspect, there is provided a method, comprising: providing an inlet assembly for a burner, the inlet assembly comprising an inlet nozzle defining an inlet aperture coupleable with an inlet conduit providing an effluent gas stream for treatment by the burner, a non-circular outlet aperture, and a nozzle bore extending along a longitudinal axis between the inlet aperture and the outlet aperture for conveying the effluent gas stream from the inlet aperture to the outlet aperture for delivery to the combustion chamber of the burner, the nozzle bore having an inlet portion extending from the inlet aperture and an outlet portion extending to the non-circular outlet aperture; and supplying the effluent stream to the inlet aperture.

In one embodiment, the inlet assembly comprises a baffle coupling the inlet portion with the outlet portion, the baffle defining a baffle aperture having a changeable cross-sectional area positioned within the nozzle bore, the baffle aperture having a reduced cross-sectional area compared to that of the outlet portion adjacent the baffle and the method comprises: varying the changeable cross-sectional area in response a velocity of the effluent gas stream.

Embodiments of the second aspect provide features corresponding to features of embodiments of the first aspect mentioned above.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DETAILED DESCRIPTION OF THE INVENTION

Overview

Before discussing the embodiments in any more detail, first an overview will be provided. Embodiments provide a burner inlet assembly. Although the following embodiments describe the use of radiant burners, it will be appreciated that the inlet assembly may be used with any of a number of different burners such as, for example, turbulent flame burners or electrically heated oxidisers. Radiant burners are well known in the art, such as that described in EP 0 694 735.

Embodiments provide a burner inlet assembly having an inlet nozzle having a non-uniform bore extending from its inlet aperture which couples with an inlet conduit which provides the effluent gas stream to an outlet aperture which provides the effluent gas stream to the combustion chamber of the burner. In particular, the configuration of the nozzle bore changes from an inlet aperture which can couple with the inlet conduit and which provides the effluent gas stream to a non-circular outlet aperture. The non-circular outlet aperture provides a non-circular effluent gas stream flow into the combustion chamber. The non-circular effluent gas flow enables a greater volume of effluent gas stream to be introduced into the combustion chamber whilst still achieving or exceeding the required levels of abatement. This is because a non-circular effluent gas stream provides a reduced distance along which diffusion and reaction needs to occur compared to that of an equivalent circular effluent gas stream. Hence, an increased volume of effluent gas stream can be abated, compared to that of an equivalent circular effluent gas stream.

The performance of the abatement is further improved in embodiments by providing a baffle or restriction within the inlet nozzle between the inlet aperture and the outlet aperture. This baffle uses a baffle aperture to perform the restriction, which has a shape generally matching that of the outlet aperture and which is slightly smaller in cross-sectional area. This provides a sharp discontinuity downstream from the baffle which causes an expansion of flow to occur within the outlet portion extending from the baffle to the non-circular outlet aperture. The performance can be further improved in embodiments by providing the baffle with a shutter mechanism, which operates to change the area of the baffle aperture under different circumstances.

Head Assembly

Figure 1:
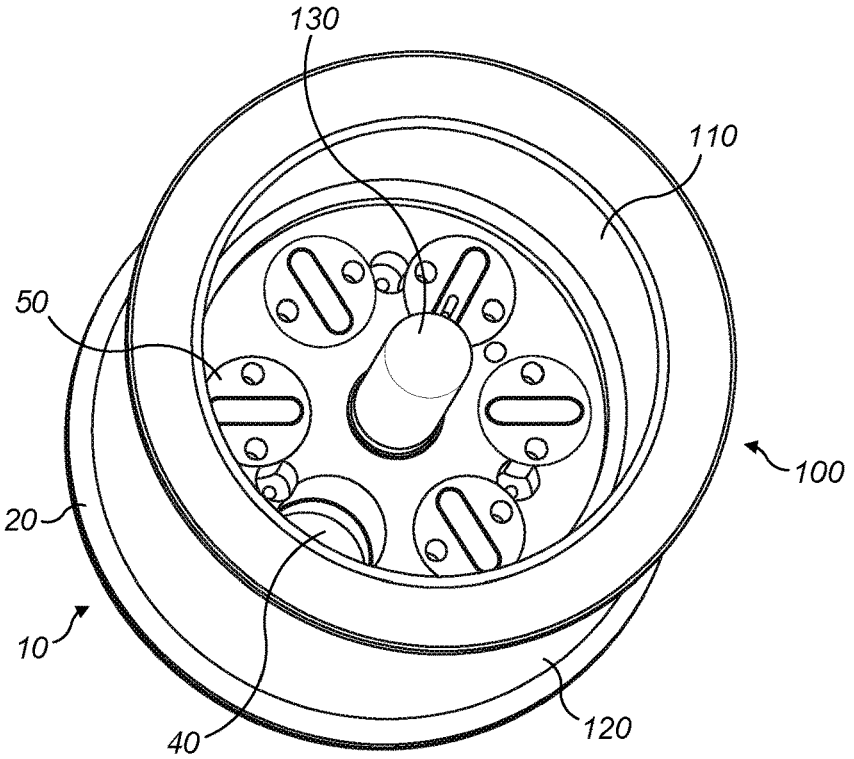
FIG. 1 is a perspective view showing the underside of a head assembly and burner according to one embodiment.
Figure 2:
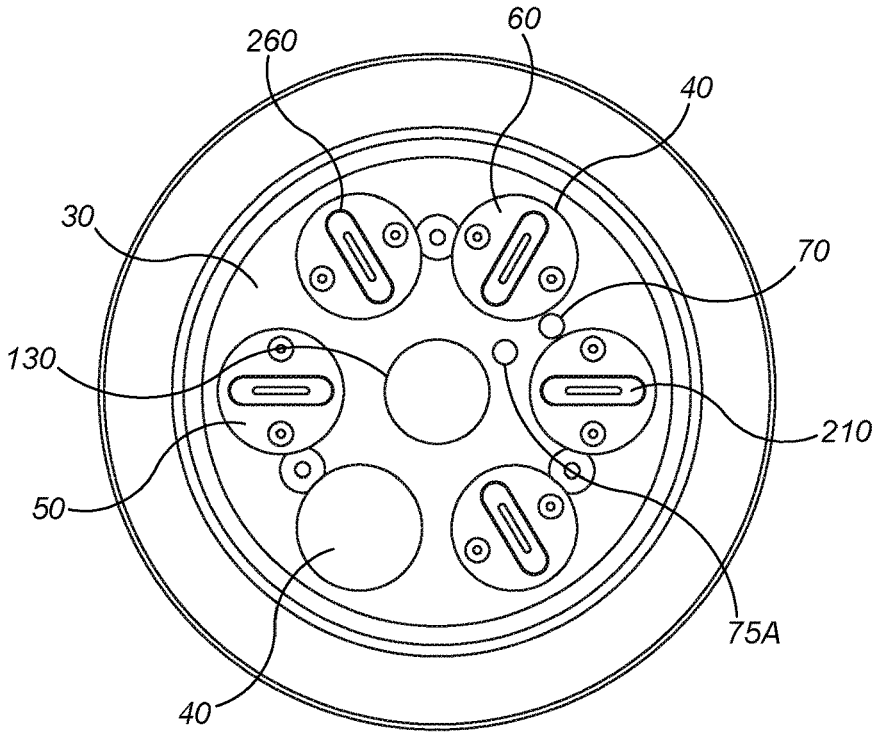
FIG. 2 is an underside plan view of the head assembly and burner of FIG. 1.

FIGS. 1 and 2 illustrate a head assembly, generally 10, according to one embodiment coupled with a radiant burner assembly 100. In this example, the radiant burner assembly 100 is a concentric burner having an inner burner 130 and an outer burner 110. A mixture of fuel and oxidant is supplied via a plenum (not shown) within a plenum housing 120 to the outer burner 110 and a conduit (not shown) to the inner burner 130.

The head assembly 10 comprises three main sets of components. The first is a metallic (typically stainless steel) housing 20, which provides the necessary mechanical strength and configuration for coupling with the radiant burner assembly 100. The second is an insulator 30 which is provided within the housing 20 and which helps to reduce heat loss from within a combustion chamber defined between the inner burner 130 and the outer burner 110 of the radiant burner assembly 100, as well as to protect the housing 20 and items coupled thereto from the heat generated within the combustion chamber. The third are inlet assemblies 50 which are received by a series of identical, standardized apertures 40 (see FIG. 2) provided in the housing 20. This arrangement enables individual inlet assemblies 50 to be removed for maintenance, without needing to remove or dissemble the complete head assembly 10 from the remainder of the radiant burner assembly 100.

The embodiment shown in FIG. 1 utilises five identical inlet assemblies 50, each mounted within a corresponding aperture 40, the sixth aperture is shown vacant. It will be appreciated that not every aperture 40 may be filled with an inlet assembly 50 which receives an effluent or process fluid, or other fluid, and may instead receive a blanking inlet assembly to completely fill the aperture 40, or may instead receive an instrumentation inlet assembly housing sensors in order to monitor the conditions within the radiant burner. Also, it will be appreciated that greater or fewer than six apertures 40 may be provided, that these need not be located circumferentially around the housing, and that they need not be located symmetrically either.

As can also be seen in FIGS. 1 and 2, additional apertures are provided in the housing 20 in order to provide for other items such as, for example, a sight glass 70 and a pilot 75A.

The inlet assemblies 50 are provided with an insulator 60 to protect the structure of the inlet assemblies 50 from the combustion chamber. The inlet assemblies 50 are retained using suitable fixings such as, for example, bolts (not shown) which are removed in order to facilitate their removal and these are also protected with an insulator (not shown). The inlet assemblies 50 have an outlet aperture 260 and a baffle portion 210 as will be explained in more detail below.

Inlet Assembly

Figure 3:
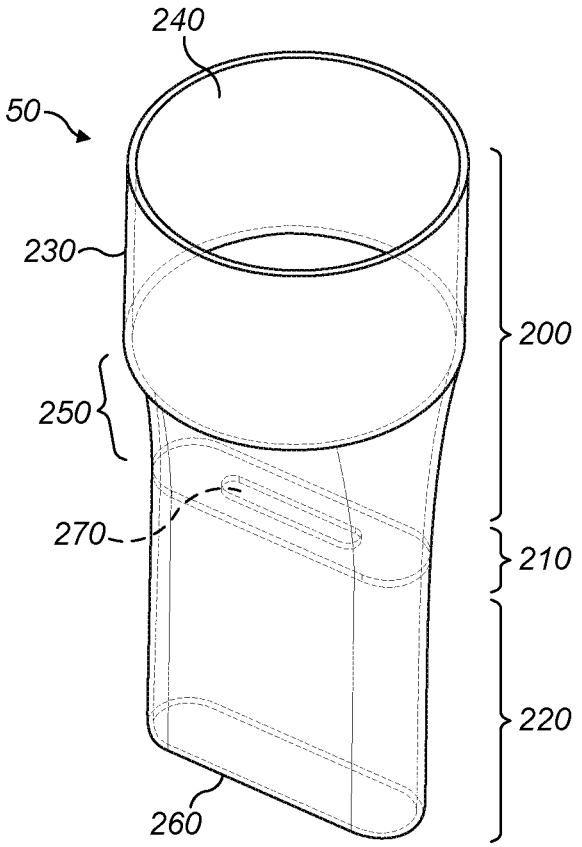
FIG. 3 shows the inlet assembly according to one embodiment.
Figure 4:
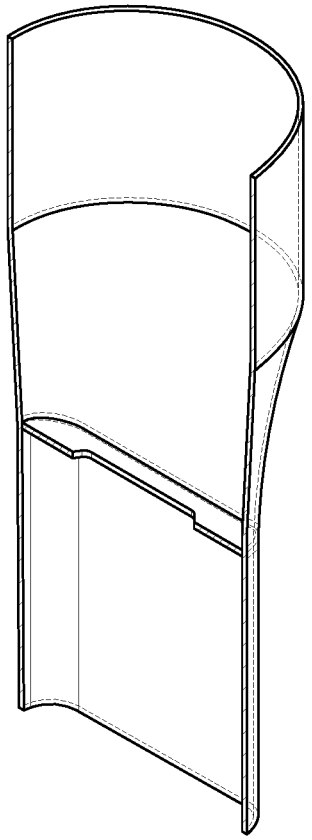
FIG. 4 shows a cross-section through the inlet assembly of FIG. 3.

FIG. 3 shows the inlet assembly 50, according to one embodiment. FIG. 4 shows a cross-section through the inlet assembly 50. The inlet assembly 50 forms a conduit for the delivery of the effluent gas stream provided by an inlet conduit (not shown) which delivers the effluent gas stream to the inlet assembly and to the combustion chamber. The inlet assembly 50 receives the effluent stream which is shaped by the inlet conduit and reshapes the effluent stream for delivery to the combustion chamber.

The inlet assembly 50 has three main portions which are an inlet portion 200, a baffle portion 210 and an outlet portion 220. It will be appreciated that an insulating shroud (not shown) may be provided on the outer surface of at least the outlet portion 220 which fits with the aperture 40A.

Inlet Portion

The inlet portion 200 comprises a cylindrical section 230 which defines an inlet aperture 240. It will be appreciated that the inlet portion 200 may be any shape which matches that of the inlet conduit. The cylindrical portion 230 couples with the inlet conduit to receive the effluent gas stream, which flows towards the baffle portion 210. In this embodiment, the inlet portion 200 is fed from a 50 mm internal diameter inlet pipe. Downstream from the cylindrical portion 230, the inlet portion transitions from a circular cross-section to a non-circular cross-section, which matches that of the outlet portion 220. Accordingly, there is a lofted transition portion 250 where the cross-sectional shape of the inlet portion 200 transitions from circular to non-circular. In this example, the cross-sectional shape changes from a circle to an obround. However, it will be appreciated that other transitions are possible. The provision of the matching cylindrical portion 230 and the lofted portion 250 upstream of the baffle portion 210 helps to prevent the build-up of deposits.

Outlet Portion

The outlet portion 220 maintains the same obround cross-sectional shape and area along its axial length and defines an outlet aperture 260 which provides the effluent stream to the combustion chamber. In this embodiment, the outlet portion is of obround cross-section of 8 mm internal radius on 50 mm centres, and is 75 mm long. Although in this embodiment the outlet portion 220 has a constant shape along its axial length, it will be appreciated that this portion may be tapered.

Baffle Portion

Located between the inlet portion 200 and the outlet portion 220 is a baffle portion 210. In this it example, the baffle portion 210 comprises a plate having a baffle aperture 270. The baffle portion 210 is orientated orthogonal to the direction of flow of the effluent stream and provides a restriction to that flow. In this example, the shape of the baffle aperture 270 matches that of the cross-section of the outlet portion 220 and is symmetrically located within the baffle portion 210. The baffle aperture 270 has a smaller cross-sectional area than that of the outlet portion 220. In this embodiment, the baffle aperture is of 3 mm radius on 40 mm centres. This gives a slot velocity and nominal nozzle velocity of 24 m/s and 5 m/s respectively, at 300 litres per minute, compared to 4 m/s for a conventional 16 mm internal diameter nozzle at 50 litres per minute and 5 m/s at 60 litres per minute.

Accordingly, as can be seen, the internal volume of the cylindrical section 230 provides a continuous extension of the inlet conduit, whilst the lofted portion 250 transitions the shape of the conduit from circular to non-circular. This provides for near-laminar flow of the effluent stream until it reaches the baffle portion 210. The presence of the baffle portion 210 and its aperture 270 provides for a sharp discontinuity so that the effluent stream passing through the baffle aperture 270 undergoes an expansion of flow within the outlet portion 220. Although the presence of the baffle portion 210 is not required, as will be discussed below, including a baffle portion 210 improves the subsequent abatement performance.

Non-Circular Outlet

Figure 5:
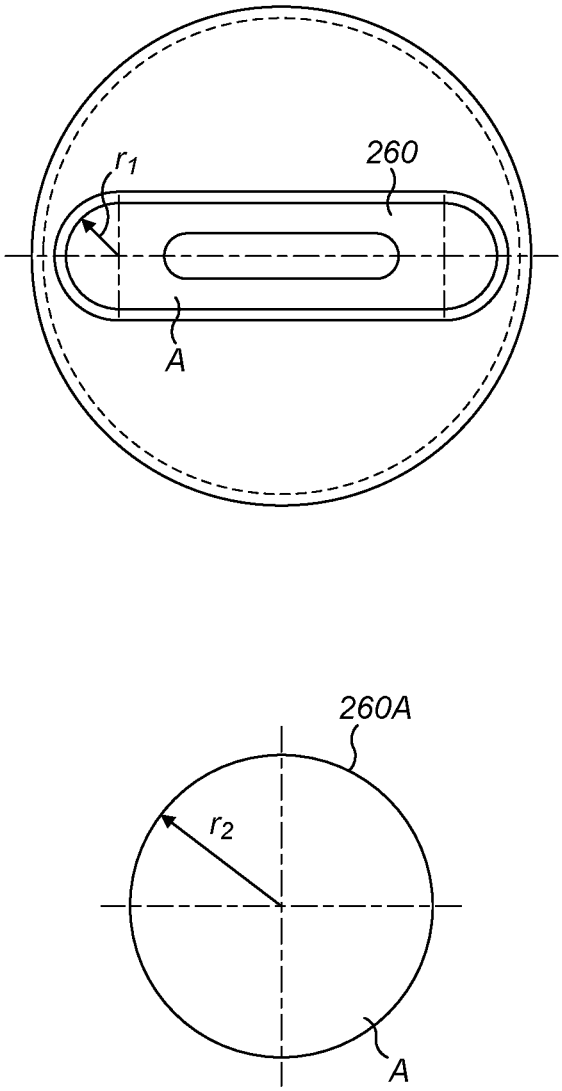
FIG. 5 shows the outlet aperture when viewed along the axial length of the inlet assembly.

FIG. 5 shows the outlet aperture 260 when viewed along the axial length of the inlet assembly 50. The outlet aperture 260 has an area A. FIG. 5 also illustrates a circular outlet aperture 260*a* having an area A equivalent to that of the outlet aperture 260.

As can be seen, in order to provide an equivalent area, the diffusion length $r_2$ for the circular outlet aperture 260*a* is significantly longer than the diffusion length $r_1$ of the outlet aperture 260.

Therefore, for the same flow rate, the time taken for diffusion and abatement to occur on an effluent stream provided by the circular outlet aperture 260A is to considerably longer than that for the effluent stream provided by the outlet aperture 260. In other words, the length of the combustion chamber needed to perform the abatement reaction for the same flow rate effluent stream provided by the circular outlet aperture 260A would need to be considerably longer than that provided by the outlet aperture 260. In other words, a more compact radiant burner is possible using the outlet aperture 260 than is possible with the circular outlet aperture 260A.

Baffle Portion—Alternative Embodiments

Figure 6:
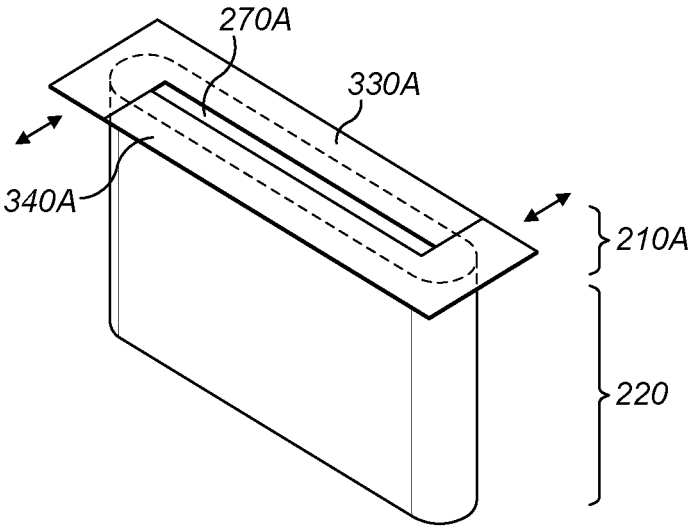
FIGS. 6 and 7 show baffle portions according to embodiments.
Figure 7:
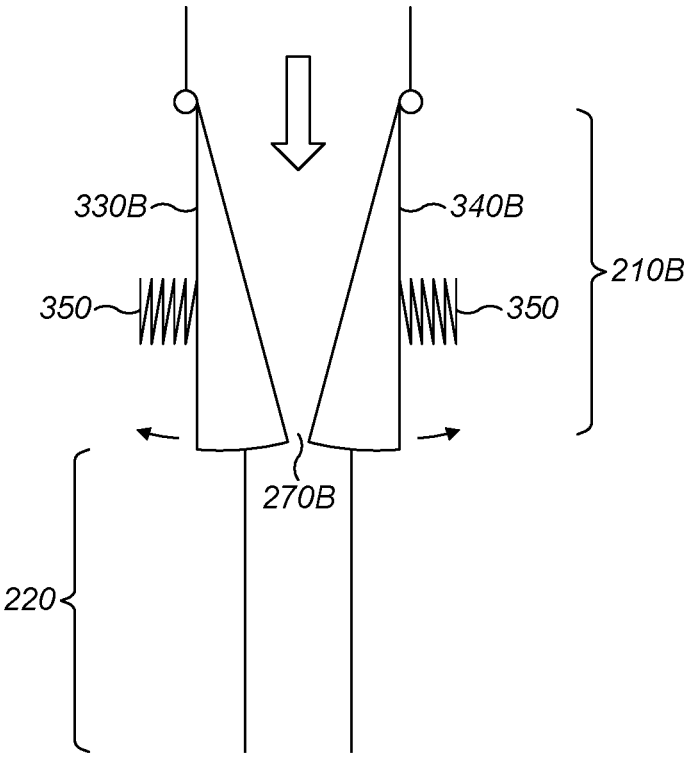

FIGS. 6 and 7 illustrate alternative arrangements for the baffle portion.

FIG. 6 shows a baffle portion 210A having shutter arrangement comprised of a pair of slidably mounted plates 330A, 340A, which together define a variable size baffle aperture 270A. In this example, the plates 330A, 340A are L-shaped. However, it will be appreciated that other shutter structures and shapes are conceivable. The plates 330A, 340A may be moved together or apart in order to change the area of the baffle aperture 270A.

FIG. 7 shows a parallel sided slot nozzle arrangement utilizing a pair of pivoting plates 330B, 340B which are biased by springs 350 to restrict the size of the baffle aperture 270B. The pivoting plates 230B, 240B are acted upon by the flow of the effluent gas stream, which increases the area of the baffle aperture 270B. It will be appreciated that other biased shutter mechanisms may be provided.

Typically, the dimensions of the baffle aperture can be changed in two ways: manually, in response to the low flow rate of gas through the nozzle, such that the throat dimensions are optimized to suit the throughput of the process gas plus pump dilution. For example, when abating a gas such as $NF_3$, a more constricted throat gives improved abatement performance, but this same throat size leads to increased deposition of solids on the burner surface when abating a particle forming gas such as $SiH_4$, in which case a less constricted throat is advantageous. Also, the throat dimensions may be optimized automatically, so that the throat of the baffle portion is deformable against a spring action or other restoring force. It will be appreciated that the use of the two opposing plates 330A, 340A are easier to adjust than adjusting the area of an equivalent circular aperture.

Performance Results

Figure 8A:
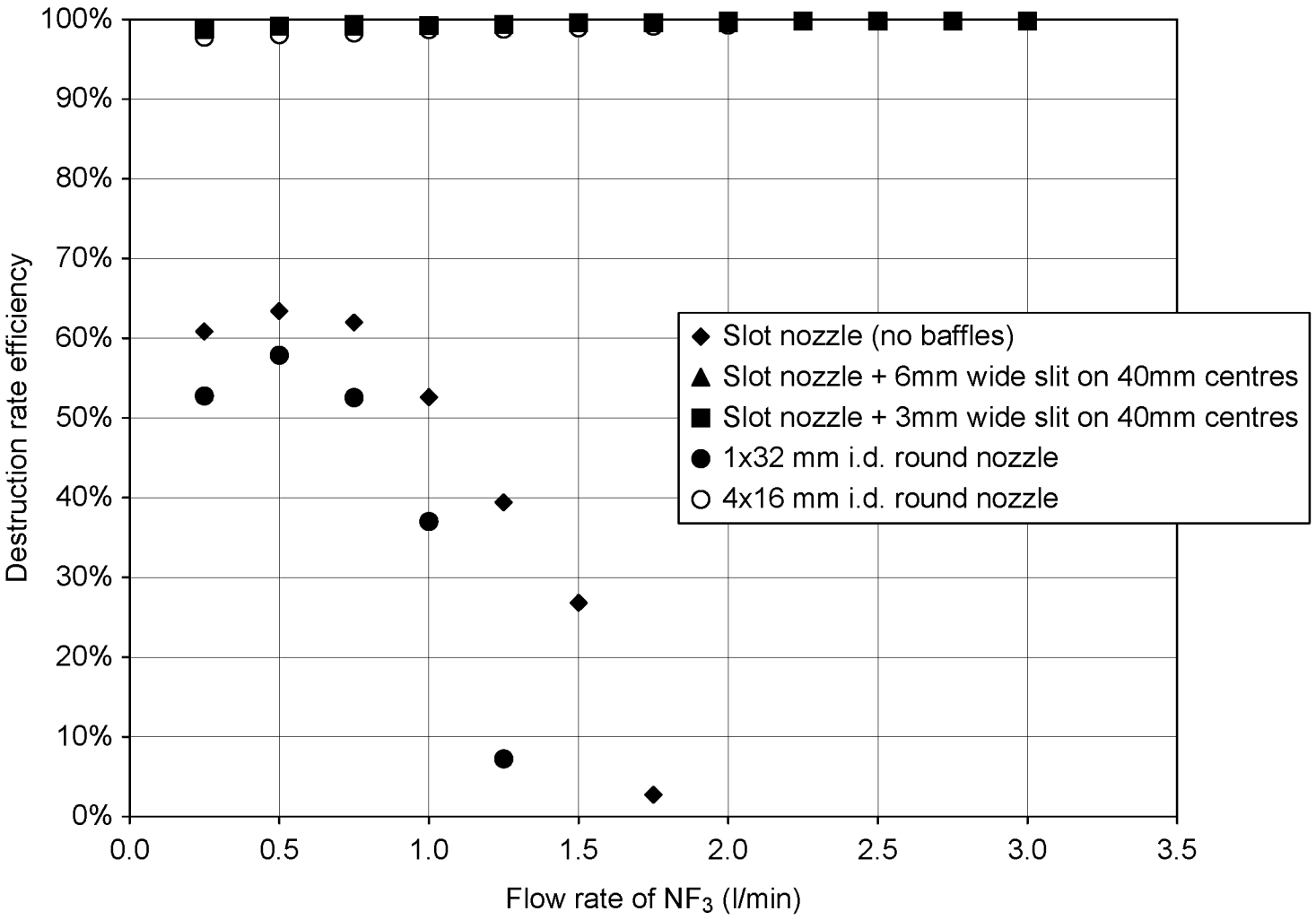
FIG. 8A is a graph showing a plot of destruction rate efficiency for $NF_3$ diluted with 200 l/min of nitrogen for different inlet assembly configurations.
Figure 8B:
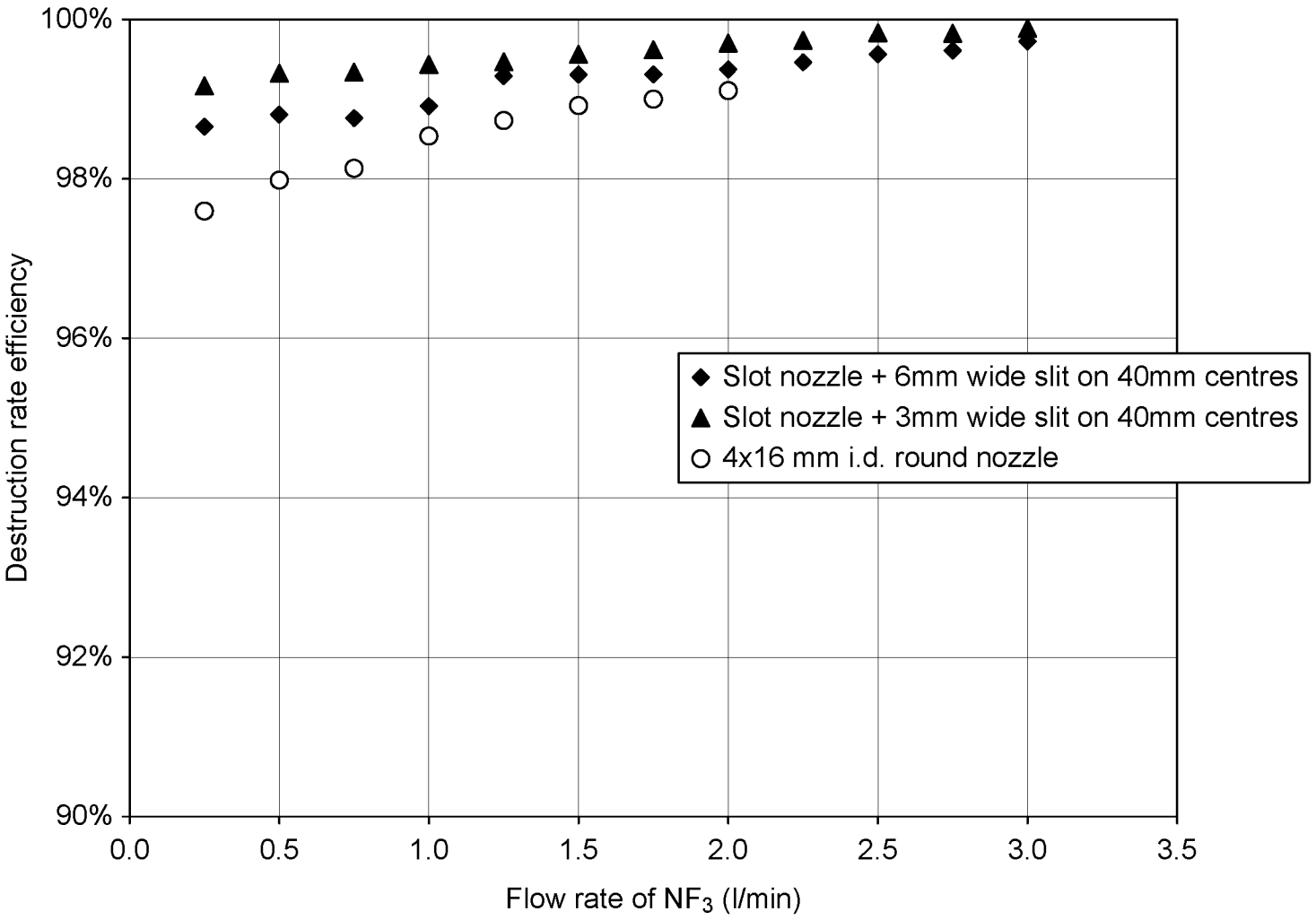
FIG. 8B is an enlargement of FIG. 8A showing a plot of $NF_3$ destruction rate efficiency diluted with 200 l/min nitrogen and showing the performance of a head assembly having a single inlet assembly of embodiments (with two different baffle apertures) compared to an existing head assembly having four 16 mm internal diameter circular inlet assemblies.
Figure 8C:
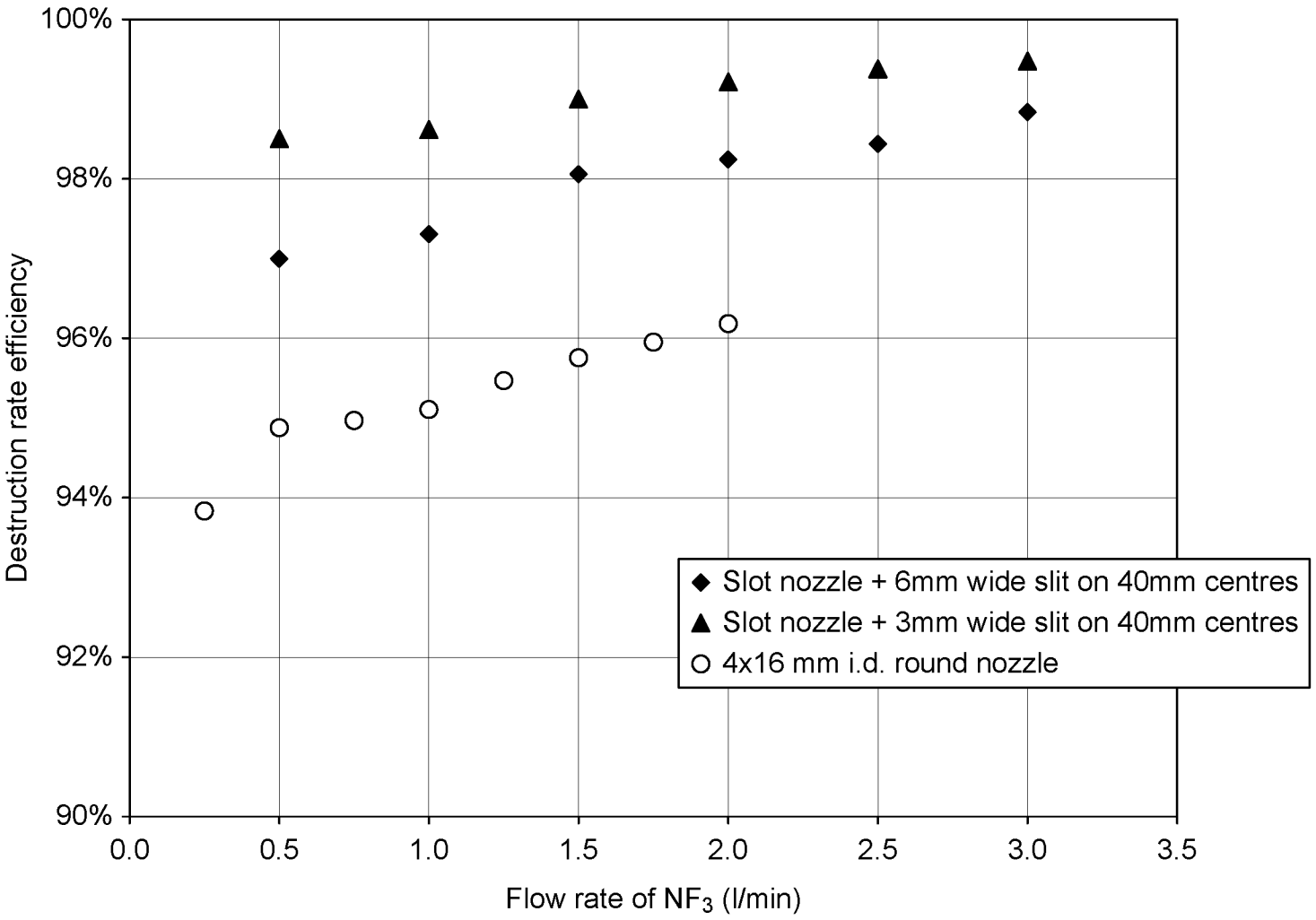
FIG. 8C is a graph showing a plot of destruction rate efficiency for $NF_3$ diluted with 300 l/min nitrogen showing the performance of a head assembly having a single inlet assembly of embodiments (with two different baffle apertures) compared to an existing head assembly having four 16 mm internal diameter circular inlet assemblies.

As can be seen in FIGS. 8A to 8C, the performance of a radiant burner using the inlet assembly of embodiments is improved compared to that of existing arrangements.

FIG. 8A shows a plot of the destruction rate efficiency for $NF_3$ which was measured as part of a simulated effluent stream with 200 l/min of nitrogen for different inlet assembly configurations feeding a 152.4 mm (6 inch) internal diameter by 304.8 mm (12 inch) axial length radiant burner operating with 36 SLM of fuel which provides a residual oxygen concentration of 9.5%, when measured in the absence of the effluent gas stream. As can be seen, using the inlet assembly of embodiments provides for significant performance improvement over an existing arrangement using a single 32 mm internal diameter circular inlet assembly. Also, those inlet assemblies of embodiments which have baffle portions provide for significant performance improvement over an existing arrangement using a four 16 mm internal diameter circular inlet assemblies, as can be seen in more detail in FIG. 8B.

FIG. 88B is an enlargement of FIG. 8A when operating under the same conditions as a standard head assembly having 4×16 mm internal diameter nozzles. The inlet assembly 50 (referred to as "slot nozzle" having different baffle aperture arrangements) slightly outperforms the standard head assembly under this dilution of nitrogen.

FIG. 8C shows the same arrangement as FIG. 8B, but with the total flow of nitrogen which dilutes the $NF_3$ having been increased to 300 SLM. As can be seen, the inlet assembly 50 ("slot nozzle" having different baffle aperture arrangements) has much improved performance compared to that of the standard head assembly under this increased fluid flow.

Providing a changeable size baffle aperture helps to further improve the performance of the burner assembly under different operating conditions. For example, for 100 SLM of nitrogen, $NF_3$ abatement is superior with a larger baffle aperture (for example, 6 mm wide), whereas for higher flow rates (for example, 200 and 300 SLM) of nitrogen, the narrower slot performs better. Furthermore, the size of the baffle aperture or orifice may be changed to not generate or to relieve a high backpressure during flow transients such as chamber pump-down when there is no process gas to be abated.

Hence, it can be seen that embodiments provide an inlet assembly to a combustive abatement system which comprises a single nozzle constructed in the form of a slot or obround, in flow communication with an inlet pipe upstream and a combustion chamber downstream. The interface between the inlet pipe and nozzle provides for a sharp discontinuity on the downstream side, such that an expansion of flow occurs within the nozzle. This arrangement is demonstrated to give enhanced destruction of the effluent stream or process gas containing, for example, $NF_3$, over existing configurations. Indeed, the performance of a single nozzle with this configuration exceeds that of a plurality of separate nozzles used in existing burner assemblies.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

| Reference Signs | |
|---|---|
| head assembly | 10 |
| housing | 20 |
| insulator | 30 |
| apertures | 40 |
| inlet assemblies | 50 |
| insulator | 60 |
| sight glass | 70 |
| pilot | 75A |
| radiant burner assembly | 100 |
| outer burner | 110 |
| plenum housing | 120 |
| inner burner | 130 |
| inlet portion | 200 |
| baffle portion | 210, 210A, 210B |
| outlet portion | 220 |
| cylindrical portion | 230 |
| inlet aperture | 240 |
| lofted portion | 250 |
| outlet aperture | 260 |
| circular outlet aperture | 260A |
| baffle aperture | 270, 270A, 270B |
| plates | 330A, 340A |
| pivoting plates | 330B, 340B |
| springs | 350 |
| area | A |
| diffusion length | $r_1$, $r_2$ |

The invention claimed is:

1. An inlet assembly for a burner, said inlet assembly comprising:

(a) an inlet nozzle defining an inlet aperture coupleable with an inlet conduit providing an effluent gas stream for treatment by said burner;

(b) a non-circular outlet aperture; and (c) a nozzle bore extending along a longitudinal axis between said inlet aperture and said outlet aperture for conveying said effluent gas stream from said inlet aperture to said outlet aperture for delivery to a combustion chamber of said burner, said nozzle bore having an outlet portion extending to said non-circular outlet aperture, and a transition portion between the inlet aperture and the outlet portion wherein the inlet aperture has a shape different from the shape of the non-circular outlet aperture and the transition portion has a shape matching the shape of the inlet aperture distal from the outlet portion and a shape matching the shape of the non-circular outlet aperture proximate the outlet portion; and (d) a baffle located at a boundary between the transition portion and said outlet portion, said baffle defining a baffle aperture positioned within said nozzle bore, said baffle aperture having a reduced cross-sectional area compared to that of said outlet portion adjacent said baffle.

2. The inlet assembly of claim 1, wherein a cross-sectional area of said transition portion reduces along said longitudinal axis from towards said outlet portion.

3. The inlet assembly of claim 1, wherein said inlet aperture is circular.

4. The inlet assembly of claim 1, wherein said outlet aperture is elongate.

5. The inlet assembly of claim 1, wherein said outlet aperture is a generally quadrilateral slot.

6. The inlet assembly of claim 1, wherein said outlet aperture is an obround.

7. The inlet assembly of claim 1, wherein said outlet aperture is formed from a plurality of co-located, discrete apertures.

8. The inlet assembly of claim 1, wherein a cross-sectional area of said outlet portion changes along said longitudinal axis from said outlet aperture towards said inlet portion.

9. The inlet assembly of claim 1, wherein said cross-sectional area of said outlet portion reduces along said longitudinal axis from said baffle to said outlet aperture.

10. The inlet assembly of claim 1, wherein a cross-sectional shape of said transition portion transitions along said longitudinal axis from a shape of said inlet aperture to a shape of said baffle aperture.

11. The inlet assembly of claim 1, wherein a shape of said baffle aperture matches that of said outlet portion adjacent said baffle.

12. The inlet assembly of claim 1, wherein said baffle aperture is formed from a plurality of co-located apertures.

13. The inlet assembly of claim 1, wherein said baffle is configured to provide said baffle aperture having a changeable cross-sectional area.

14. The inlet assembly of claim 13, wherein said baffle comprises a shutter operable to provide said changeable cross-sectional area.

15. The inlet assembly of claim 14, wherein said shutter is biased to provide said changeable cross-sectional area which varies in response a velocity of said effluent gas stream.

16. A method, comprising:

(a) providing an inlet assembly for a burner, said inlet assembly comprising an inlet nozzle defining an inlet aperture coupleable with an inlet conduit providing an effluent gas stream for treatment by said burner, a non-circular outlet aperture, a nozzle bore extending along a longitudinal axis between said inlet aperture and said outlet aperture for conveying said effluent gas stream from said inlet aperture to said outlet aperture for delivery to a combustion chamber of said burner and a baffle between said inlet aperture and said outlet aperture, said baffle defining a baffle aperture positioned within said nozzle bore, said nozzle bore having a transition portion between said inlet aperture and an outlet portion extending to said non-circular outlet aperture wherein the inlet aperture has a shape different from the shape of the non-circular outlet aperture and the transition portion has a shape matching the shape of the inlet aperture distal from the outlet portion and a shape matching the shape of the outlet aperture proximate the outlet portion, the baffle is located at the boundary of the transition portion and the outlet portion and said baffle aperture has a reduced cross-sectional area compared to that of said outlet portion adjacent said baffle; and (b) supplying said effluent stream to said inlet aperture.

17. The method of claim 16, wherein said baffle aperture has a changeable cross-sectional area and said method further comprises:

varying said changeable cross-sectional area in response a velocity of said effluent gas stream.

* * * * *